US007981181B2

(12) United States Patent
Yoo

(10) Patent No.: US 7,981,181 B2
(45) Date of Patent: Jul. 19, 2011

(54) CYCLONE DUST-SEPARATING APPARATUS AND CLEANER HAVING THE SAME

(75) Inventor: Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 406 days.

(21) Appl. No.: 12/156,314

(22) Filed: May 30, 2008

(65) Prior Publication Data

US 2009/0178568 A1 Jul. 16, 2009

Related U.S. Application Data

(60) Provisional application No. 61/011,344, filed on Jan. 16, 2008.

(30) Foreign Application Priority Data

Mar. 19, 2008 (KR) ..... 10-2008-0025615

(51) Int. Cl.
*B01D 45/12* (2006.01)

(52) U.S. Cl. ..... 55/459.1; 55/337; 55/317; 55/429; 55/DIG. 3; 96/416; 15/353; 15/350

(58) Field of Classification Search ..... 55/459.1, 55/337, 317, 429, DIG. 3; 96/416; 15/353, 15/350
See application file for complete search history.

(56) References Cited

U.S. PATENT DOCUMENTS

| | | | | |
|---|---|---|---|---|
| 4,180,390 | A * | 12/1979 | Furstenberg | 96/428 |
| 6,168,641 | B1 * | 1/2001 | Tuvin et al. | 55/337 |
| 6,546,593 | B2 * | 4/2003 | Oh et al. | 15/353 |
| 6,840,972 | B1 * | 1/2005 | Kim | 55/337 |
| 7,108,138 | B2 * | 9/2006 | Simpson | 209/720 |
| 7,789,923 | B2 * | 9/2010 | Oh et al. | 55/343 |
| 2004/0181898 | A1 * | 9/2004 | Kondo | 15/353 |
| 2004/0237248 | A1 * | 12/2004 | Oh et al. | 15/353 |
| 2005/0252179 | A1 * | 11/2005 | Oh et al. | 55/337 |
| 2006/0230715 | A1 * | 10/2006 | Oh et al. | 55/337 |
| 2006/0230720 | A1 * | 10/2006 | Han et al. | 55/345 |
| 2006/0272299 | A1 * | 12/2006 | Choi | 55/337 |
| 2007/0056578 | A1 * | 3/2007 | Aviles | 126/299 D |
| 2007/0209340 | A1 * | 9/2007 | Conrad | 55/345 |
| 2007/0266678 | A1 * | 11/2007 | Makarov et al. | 55/337 |

(Continued)

FOREIGN PATENT DOCUMENTS

DE 10 2005 062 525 6/2007

(Continued)

OTHER PUBLICATIONS

Machine translation of JP 2003-310506.*

(Continued)

*Primary Examiner* — Jason M Greene
*Assistant Examiner* — Dung Bui
(74) *Attorney, Agent, or Firm* — Ohlandt, Greeley, Ruggiero & Perle, LLP

(57) ABSTRACT

A cyclone dust-separating apparatus that may be conveniently maintained and repaired is disclosed. The cyclone dust-separating apparatus includes a cyclone chamber that separates dust using a whirling air current about a horizontal rotating axis, and a first cover that is detachably attached to an end of the cyclone chamber to expose the cyclone chamber. The first cover can be detached, so the cyclone dust-separating apparatus may be conveniently maintained and repaired.

16 Claims, 7 Drawing Sheets

U.S. PATENT DOCUMENTS

| | | | | |
|---|---|---|---|---|
| 2008/0110339 | A1* | 5/2008 | Kwok et al. | 95/31 |
| 2008/0190080 | A1* | 8/2008 | Oh et al. | 55/343 |
| 2009/0056290 | A1* | 3/2009 | Oh et al. | 55/337 |
| 2009/0101558 | A1* | 4/2009 | Wang | 210/188 |
| 2010/0224073 | A1* | 9/2010 | Oh et al. | 96/416 |

FOREIGN PATENT DOCUMENTS

| | | |
|---|---|---|
| EP | 1952745 | 8/2008 |
| EP | 1989984 | 11/2008 |
| JP | 2003-310506 | 11/2003 |
| KR | 1020000067144 | 11/2000 |
| KR | 1020020072465 | 9/2002 |
| KR | 1020020078798 | 10/2002 |
| KR | 1020040050221 | 6/2004 |
| KR | 1020070032099 | 3/2007 |

OTHER PUBLICATIONS

Search and Examination Report dated Nov. 24, 2008 corresponding to United Kingdom Patent Application No. 0813594.9.

* cited by examiner

CYCLONE DUST-SEPARATING APPARATUS AND CLEANER HAVING THE SAME

CROSS-REFERENCE TO RELATED APPLICATIONS

This application claims priority from U.S. Provisional Patent Application No. 61/011,344, filed on Jan. 16, 2008, in the United States Patent and Trademark Office, and from Korean Patent Application No. 10-2008-0025615, filed on Mar. 19, 2008, in the Korean Intellectual Property Office, the entire disclosure of both of which are incorporated herein by reference.

BACKGROUND OF THE INVENTION

1. Field of the Invention

The present disclosure relates to a cyclone dust-separating apparatus, and more particularly to a cyclone dust-separating apparatus in which maintenance and repair are convenient, and a cleaner having the same.

2. Description of the Related Art

Generally, a cyclone dust-separating apparatus causes dust-laden air drawn in from the outside to whirl rapidly inside a cyclone chamber, and uses the centrifugal force generated from the whirling air current to separate dust from the drawn-in air. Such cyclone dust-separating apparatuses have been applied to a cleaner.

If large particles of dust are drawn into the cyclone dust-separating apparatus, or if a large quantity hair is tangled together in the cyclone dust-separating apparatus, the passages of the cyclone dust-separating apparatus may become clogged. If the inside of the cyclone dust-separating apparatus becomes clogged with dust or dirt, the dust or dirt cannot be drawn in, so the cleaner cannot operate normally, and a user must disassemble the cyclone dust-separating apparatus to remove the dust or dirt from the clogged passages. However, it may be impossible or extremely complicated for the user to disassemble a conventional cyclone dust-separating apparatus, so the user needs to call a repairman. Accordingly, it is inconvenient for a user to maintain and repair the cyclone dust-separating apparatus, and a merchandiser charges additional costs for such services.

A grill to separate the dust or dirt may be mounted in the cyclone dust-separating apparatus in order to enhance dust-separating efficiency. If a user uses a cleaner for a long time, large amounts of dust or dirt become attached to the grill. Therefore, a large pressure drop arises, and an excessive load is applied to the motor generating the suction force, and the separating efficiency deteriorates. In extreme cases, even the grill may become completely clogged. As described above, it is inconvenient to use a conventional cyclone dust-separating apparatus, in that it is difficult to remove dust or dirt from the grill.

A cyclone dust-separating apparatus cannot reliably separate the small particles of dust or dirt, so an auxiliary filter may be mounted to the cleaner. However, since a filter is disposed inside the cleaner, users should experience inconvenience when changing filters.

SUMMARY OF THE INVENTION

Exemplary embodiments of the present invention address at least the above problems and/or disadvantages and other disadvantages not described above. Also, the present invention is not required to overcome the disadvantages described above, and an exemplary embodiment of the present invention may not overcome any of the problems described above.

The present disclosure provides a cyclone dust-separating apparatus in which maintenance and repair are convenient, and a cleaner having the same.

According to an exemplary aspect of the present invention, there is provided a cyclone dust-separating apparatus, including a cyclone chamber that separates dust using a whirling air current about a horizontal rotating axis; and a first cover that is detachably attached to an end of the cyclone chamber to expose the cyclone chamber.

A grill may be formed in the cyclone chamber to separate dust larger than a predetermined particle size.

The apparatus may further include a first hinge unit that rotatably fixes the first cover to the cyclone chamber.

A stabilizer pipe may be formed inside the first cover to guide the whirling air current.

A sealing gasket may be formed around the outer surface of the first cover.

The apparatus may further include a second cover that is detachably attached to an opposite end of the cyclone chamber in order to expose the cyclone chamber.

The apparatus may further include a second hinge unit that rotatably fixes the second cover to the cyclone chamber.

A sealing gasket may be formed around the outer surface of the second cover.

The second cover may include a filter member housing to mount a filter member.

The filter member housing may include a gutter to prevent the dust from dropping when the filter member is changed.

Air holes may be formed to the filter member housing to allow air to pass through.

The apparatus may further include an inlet through which dust-laden air flows into the cyclone chamber; and an outlet through which air from which dust has been separated by the cyclone chamber is discharged.

The inlet may be parallel with the outlet, and the inlet and outlet may be disposed on a rear surface of the cyclone chamber.

The inlet may be disposed on the rear surface, and the outlet may be disposed on a side surface of the cyclone chamber.

The cyclone chamber may be made of a transparent material.

The cyclone chamber may be made of a semitransparent material.

According to another exemplary aspect of the present invention, there is provided a cleaner including a cleaner body; a brush assembly that draws in dust-laden air from a surface being cleaned; and a cyclone dust-separating apparatus that separates the dust from the air, and is horizontally mounted to the cleaner body, wherein the cyclone dust-separating apparatus may include a cyclone chamber that separates dust-laden air using a whirling air current about a horizontal rotating axis; and a first cover that is detachably attached to an end of the cyclone chamber in order to expose the cyclone chamber.

A grill may be formed in the cyclone chamber to separate dust larger than a predetermined particle size.

The cleaner may further include a first hinge unit that rotatably fixes the first cover to the cyclone chamber.

The cleaner may further include a second cover that is detachably attached to an opposite end of the cyclone chamber in order to expose the cyclone chamber.

The cleaner may further include a second hinge unit that rotatably fixes the second cover to the cyclone chamber.

The second cover may include a filter member housing to mount a filter member.

The filter member housing may include a gutter to prevent the dust from dropping when the filter member is changed.

The cyclone chamber may be made of a transparent material.

The cyclone chamber may be made of a semitransparent material.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF THE INVENTION

Figure 1:
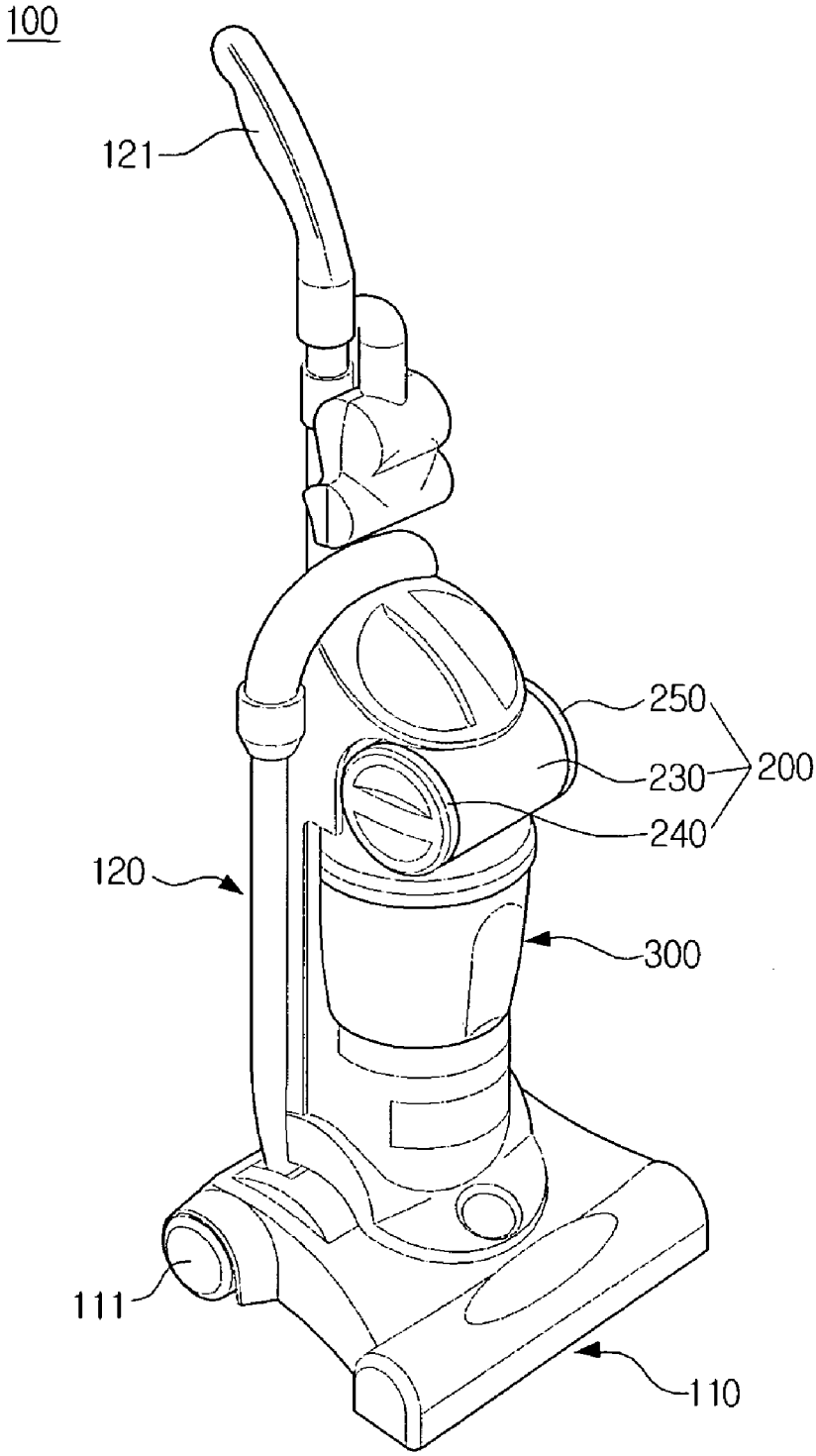
FIG. 1 is a perspective view illustrating a vacuum cleaner according to an exemplary embodiment of the present disclosure.

Certain exemplary embodiments of the present invention will now be described in greater detail with reference to the accompanying drawings.

In the following description, the same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

Figure 2:
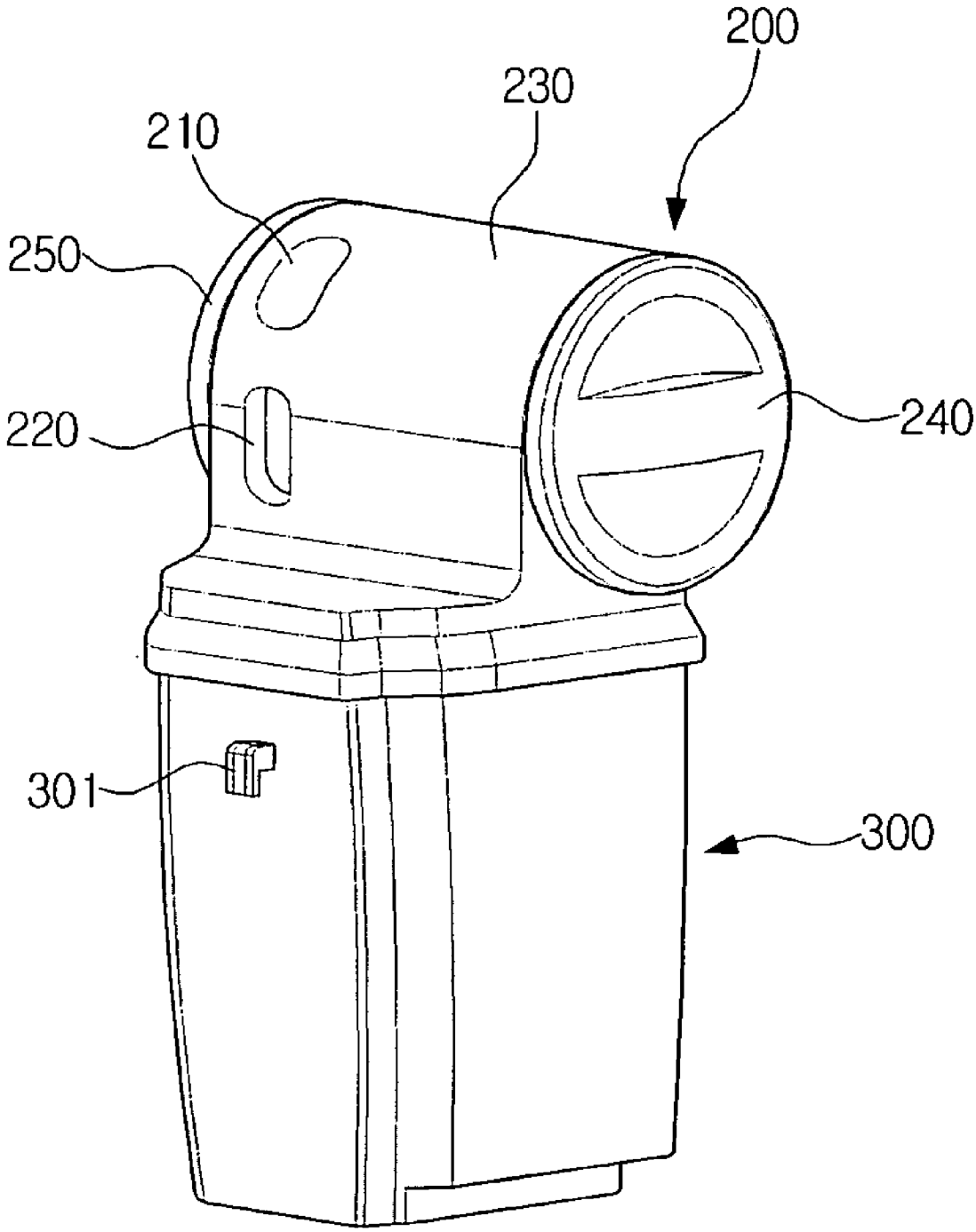
FIG. 2 is a perspective view illustrating a cyclone dust-separating apparatus mounted in the vacuum cleaner of FIG. 1.
Figure 3:
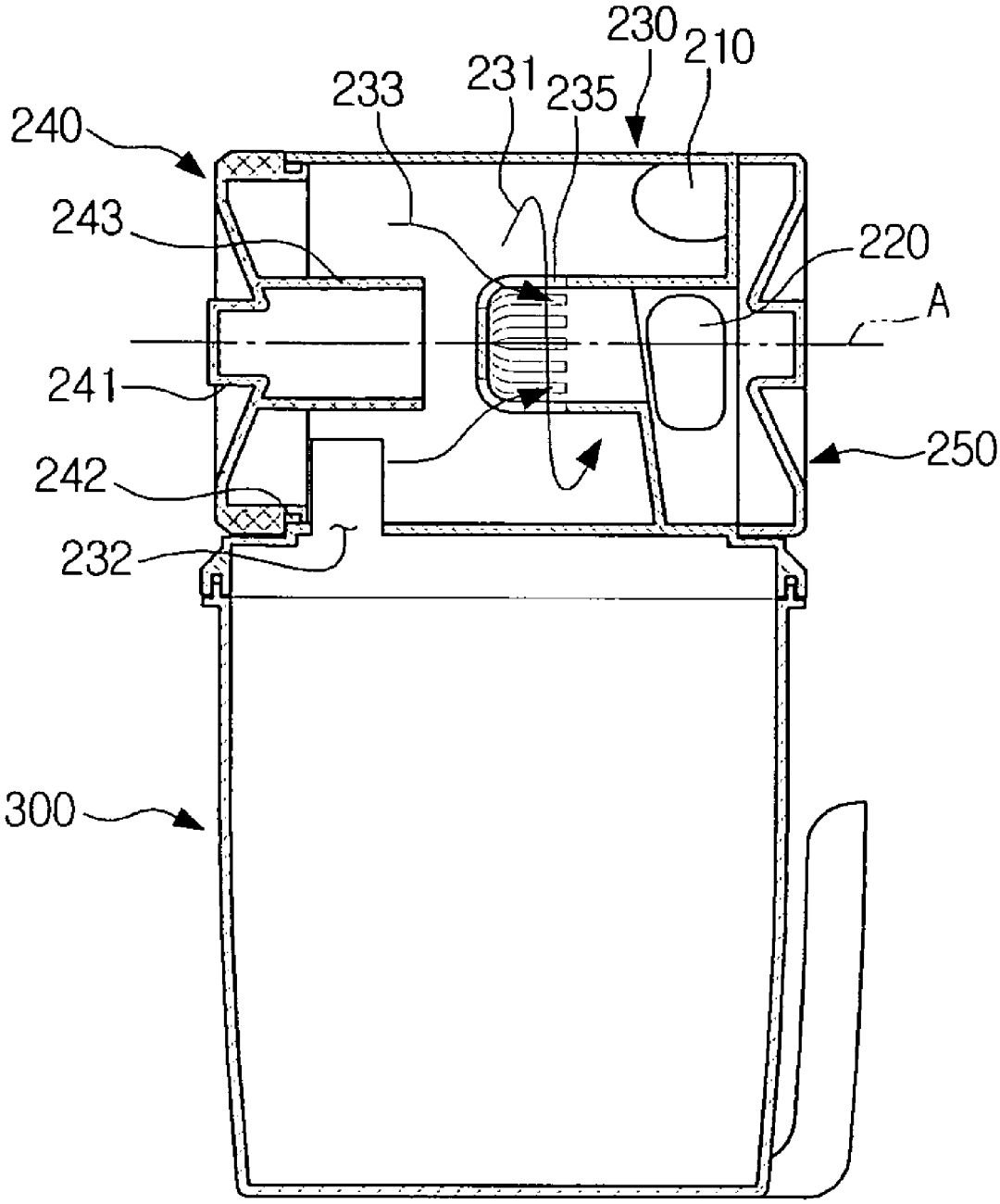
FIG. 3 is a vertical sectional view illustrating the cyclone dust-separating apparatus of FIG. 2.

FIG. 1 is a perspective view illustrating a vacuum cleaner according to an exemplary embodiment of the present disclosure, FIG. 2 is a perspective view illustrating a cyclone dust-separating apparatus mounted in the vacuum cleaner of FIG. 1, and FIG. 3 is a sectional view illustrating the cyclone dust-separating apparatus of FIG. 2.

A cleaner 100 according to an exemplary embodiment of the present disclosure may include a brush assembly 110, a cleaner body 120, a cyclone dust-separating apparatus 200, and a dust receptacle 300.

The brush assembly 110 draws in dust-laden air from a surface being cleaned. The brush assembly 110 has wheels 111, so a user can conveniently move the cleaner 100.

The cleaner body 120 includes a motor, which is not shown. The motor generates a suction force to draw in dust-laden air. The cleaner body 120 includes a handle 121, which a user grasps in order to clean a surface being cleaned. The cyclone dust-separating apparatus 200 is detachably attached to the cleaner body 120.

The cyclone dust-separating apparatus 200 separates dust from air drawn in through the brush assembly 110. The cyclone dust-separating apparatus 200 according to the exemplary embodiment of the present disclosure is mounted horizontally on the cleaner body 120 as shown in FIGS. 1 to 3. The assembly of the cleaner 100 needs to be appropriately packed in order for the cleaner to be miniaturized. If the cyclone dust-separating apparatus 200 is mounted horizontally on the cleaner body 120 as in the exemplary embodiment of the present disclosure, the height of the cleaner 100 is reduced, so the size of the cleaner 100 is miniaturized. In addition, the inside of the cyclone dust-separating apparatus 200 is exposed by opening a first cover 240, which will be explained below. Accordingly, a user can conveniently clean the inside of the cyclone dust-separating apparatus 200, which is useful for maintaining and repairing the cyclone dust-separating apparatus 200. The cyclone dust-separating apparatus 200 may include an inlet 210, an outlet 220, a cyclone chamber 230, the first cover 240, and a second cover 250.

The inlet 210 is provided on a rear surface of the cyclone chamber 230. Referring to FIG. 2, dust-laden air drawn in through the brush assembly 110 flows into the brush assembly 110 through the inlet 210.

The cyclone chamber 230 separates dust from air, and the air is discharged externally through the outlet 220. In the illustrated embodiment, the outlet 220 is provided parallel to the inlet 210 on the rear surface of the cyclone chamber 230. However, it is contemplated by the present disclosure for there to be no limitation on the arrangement of the inlet 210 and outlet 220. For example, the outlet 220 may be disposed on a side surface of the cyclone chamber 230, that is, on a surface wherein the second cover 250 is provided.

The cyclone chamber 230 separates dust from air using the whirling air current. As the inlet 210 is biased toward a side from the center of the cyclone chamber 230 in FIG. 3, the whirling air current is generated, as indicated by arrow 231. The cyclone dust-separating apparatus 200 is mounted horizontally on the cleaner body 120, so the rotating axis A of the whirling air current is formed in a horizontal direction. The dust drawn into the cyclone chamber 230 is moved away from the rotating axis A of the whirling air current by the centrifugal force. And then the dust falls down into the dust receptacle 300 through a dust outlet 232. The air separated from the dust flows toward the outlet 220 as indicated by arrow 233.

A grill 235 is formed inside the cyclone chamber 230 to separate dust greater than a predetermined particle size. The grill 235 prevents the dust that has not been separated by the centrifugal force from being discharged to the outlet 220.

The first cover 240 is detachably attached to the cyclone chamber 230 so that the cyclone chamber 230 may be exposed. A grip portion 241 is formed on the first cover 240 as shown in FIG. 3, and a user holds the grip portion 241 in order to detach the first cover 240 from the cyclone chamber 230. If a user uses the cleaner 100 for a long period of time, a large amount of dust may be attached to the grill 235, so the pressure drop arises, and the dust-separating efficiency of the cleaner 100 deteriorates. In this case, a user may detach the first cover 240 from the cyclone chamber 230 conveniently, and clean inside the cyclone chamber 230 and around the grill 235. The user may thus maintain and repair the cyclone dust-separating apparatus 200 conveniently.

The cyclone chamber 230 may be made of transparent or semitransparent material. A user can see the inside of the cyclone chamber 230 clearly, and know when the cyclone dust-separating apparatus 200 has to be repaired.

A sealing gasket 242 is formed around the outer surface of the first cover 240, in order to seal a gap between the first cover 240 and the cyclone chamber 230.

A stabilizer pipe 243 is formed inside the first cover 240, in order to guide the whirling air current that is generated in the cyclone chamber 230. The stabilizer pipe 243 guides the whirling air current, and thus the dust separating efficiency is enhanced.

The second cover 250 is fixedly attached to a surface of the cyclone chamber 230 opposite the first cover 240. However, the second cover 250 may also be detachably attached to the cyclone chamber 230. The second cover 250 may be formed identically to that of the first cover 240, taking design into consideration.

The dust receptacle 300 is disposed under the cyclone dust-separating apparatus 200, and stores dust or dirt discharged from the dust outlet 232. The dust receptacle 300 is detachably attached to the cyclone dust-separating apparatus 200. If the dust receptacle 300 is jammed with dust, a user may separate the dust receptacle 300 from the dust-separating apparatus 200 and removes the stored dust from the dust receptacle 300. A connecting member 301 is formed on a rear surface of the dust receptacle 300 as shown in FIG. 2. The connecting member 301 attaches the cyclone dust-separating apparatus 200 and the dust receptacle 300 to the cleaner body 120.

The operation of the cyclone dust-separating apparatus 200 according to an exemplary embodiment of the present disclosure will be explained below.

The motor mounted in the cleaner body 120 generates a suction force, which causes the brush assembly 110 to draw in dust-laden air from a surface being cleaned. The dust-laden air flows into the cyclone chamber 230 through the inlet 210. The whirling air current is generated in the cyclone chamber 230 about the horizontal rotating axis A, and the stabilizer pipe 243 guides the whirling air current. The centrifugal force causes the dust to enter the dust receptacle 300 through the dust outlet 232. The grill 235 prevents the dust that is not separated by the centrifugal force from being discharged to the outlet 220. If large dust particles or tangled hairs clog the passage of the cyclone chamber 230, or become attached to the grill 235, a large load is applied to the motor and dust-separating efficiency deteriorates, even reaching a state in which the cleaner 100 does not operate. In this case, the user may detach the first cover 240 from the cyclone chamber 230, and clean the inside of the cyclone chamber 230 and the grill 235 easily.

Another exemplary embodiment of the present disclosure will be explained with reference to FIGS. 4 to 8.

Figure 4:
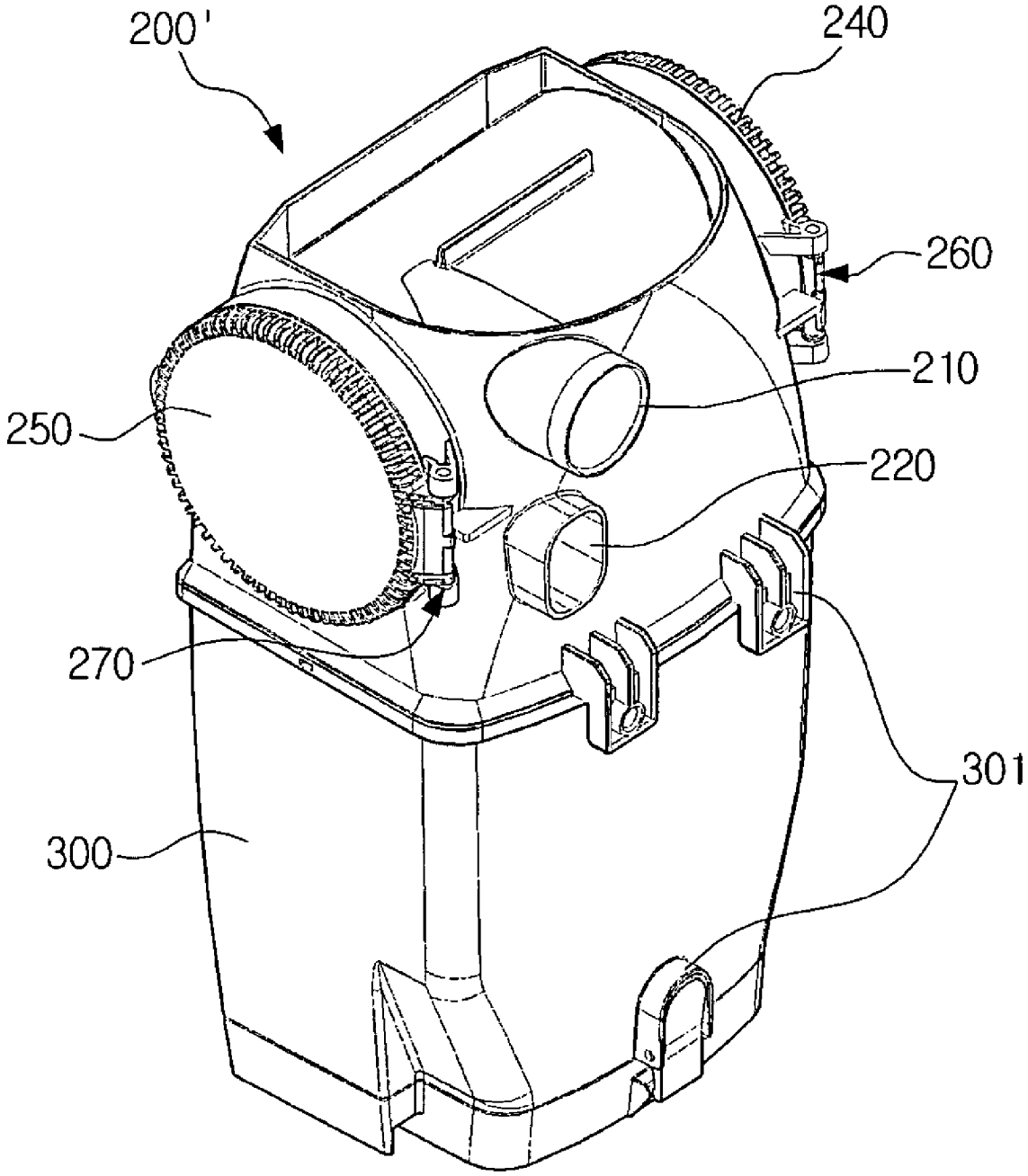
FIG. 4 is a perspective view illustrating a cyclone dust-separating apparatus according to another exemplary embodiment of the present disclosure.
Figure 5:
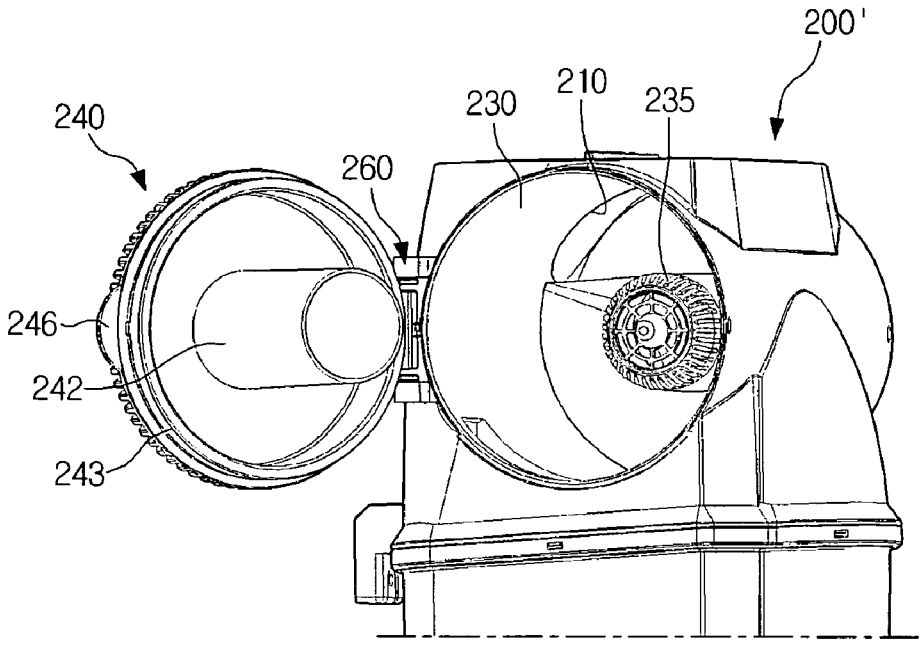
FIG. 5 is a first side perspective view illustrating the cyclone dust-separating apparatus of FIG. 4, in which first and second covers are opened.
Figure 6:
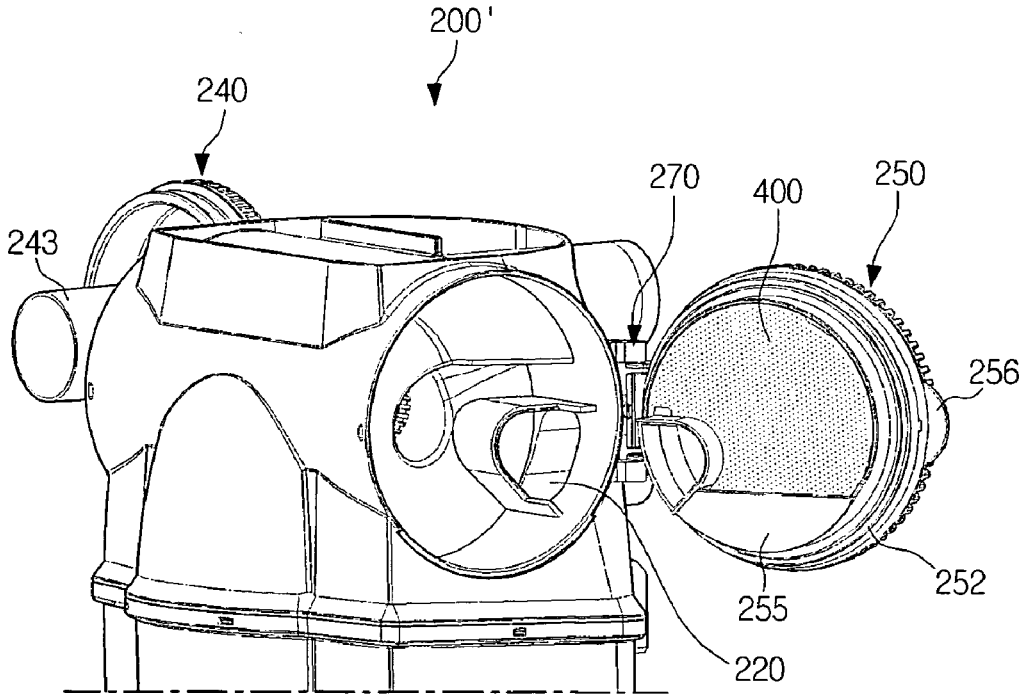
FIG. 6 is a second side perspective view illustrating the cyclone dust-separating apparatus of FIG. 4, in which first and second covers are opened.
Figure 7:
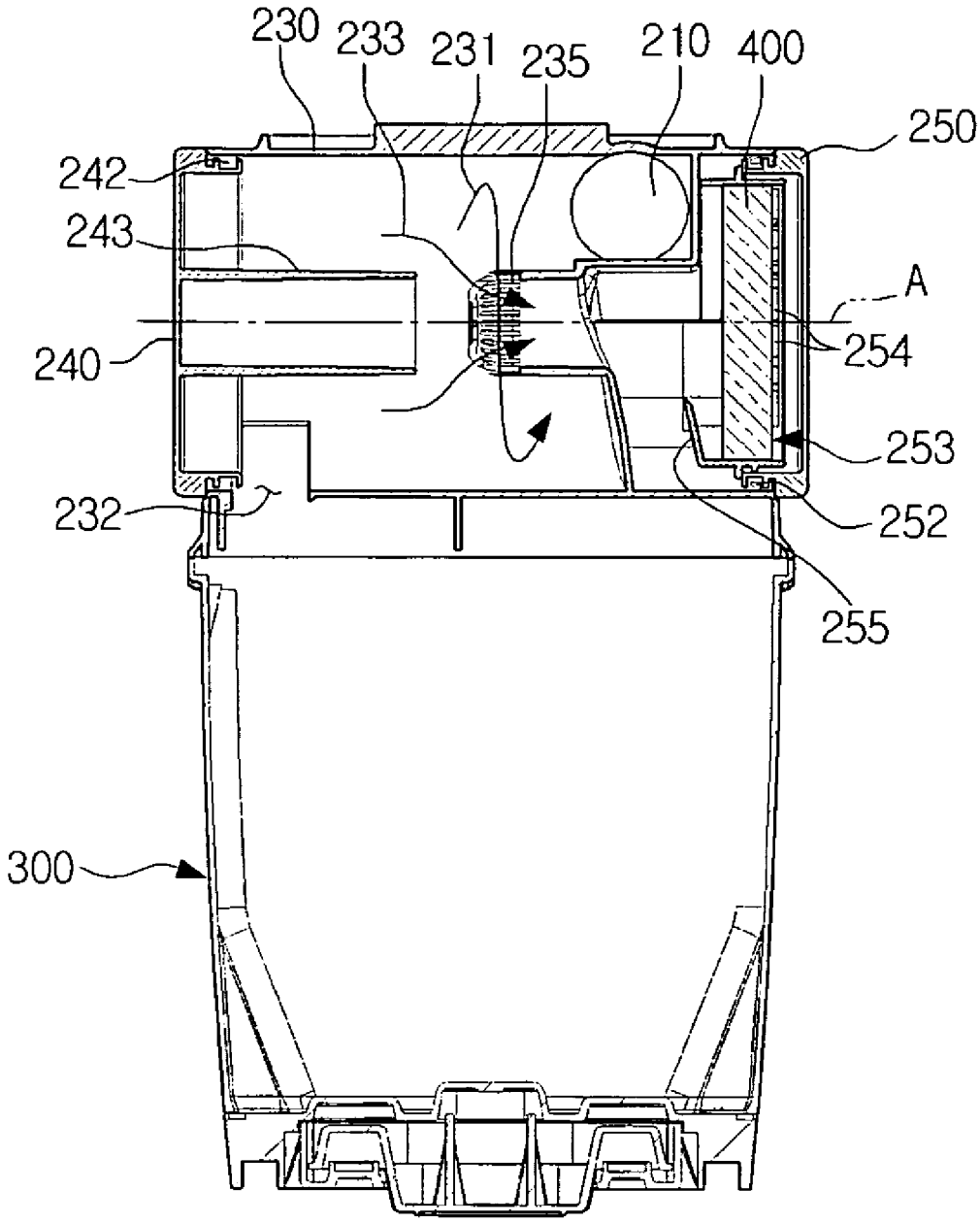
FIG. 7 is a vertical sectional view illustrating the cyclone dust-separating apparatus of FIG. 4.
Figure 8:
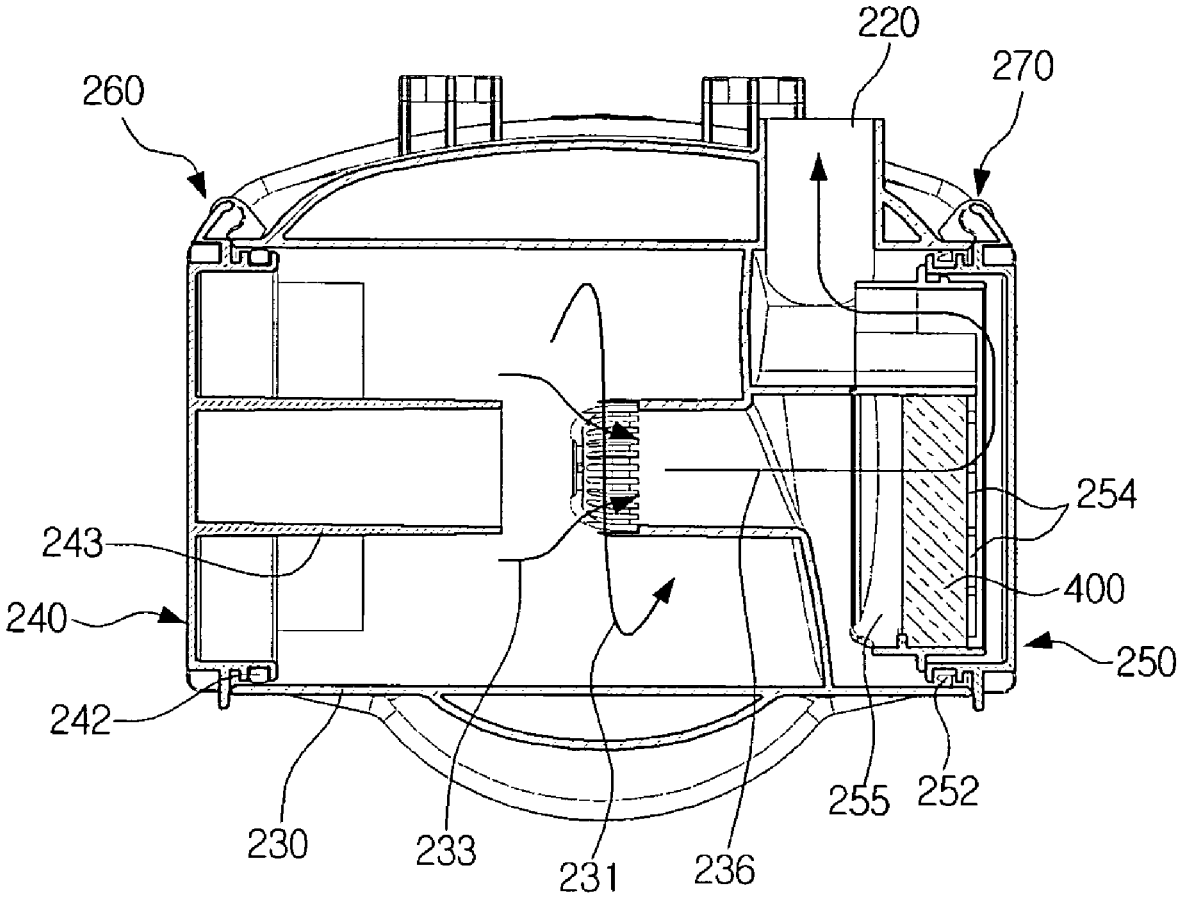
FIG. 8 is a horizontal sectional view illustrating the cyclone dust-separating apparatus of FIG. 4.

FIG. 4 is a perspective view illustrating a cyclone dust-separating apparatus according to another exemplary embodiment of the present disclosure, FIGS. 5 and 6 are perspective views illustrating the cyclone dust-separating apparatus of FIG. 4, in which first and second covers are opened, FIG. 7 is a vertical sectional view illustrating the cyclone dust-separating apparatus of FIG. 4, and FIG. 8 is a horizontal sectional view illustrating the cyclone dust-separating apparatus of FIG. 4.

Parts in common with the foregoing exemplary embodiments of the present disclosure are marked with the same reference numerals in the drawings.

A cyclone dust-separating apparatus 200' according to the second exemplary embodiment of the present disclosure may include an inlet 210, an outlet 220, a cyclone chamber 230, a first cover 240, a second cover 250, a first hinge unit 260, and a second hinge unit 270.

Since the inlet 210, outlet 220, cyclone chamber 230, and first cover 240 perform the same function as the equivalent parts described in the foregoing exemplary embodiment, detailed description will be omitted.

The first hinge unit 260 fixes the first cover 240 rotatably to the cyclone chamber 230. The first hinge unit 260 enables a user to conveniently detach the first cover 240 from the cyclone chamber 230. A first protrusion 246 is formed on the side of the first cover 240 as shown in FIG. 5, and a user may thus hold the first protrusion 246 in order to detach the first cover 240 from the cyclone chamber 230, or to attach the first cover 240 to the cyclone chamber 230.

The second hinge unit 270 fixes the second cover 250 rotatably to the cyclone chamber 230. A second protrusion 256 is formed on the side of the second cover 250 as shown in FIG. 6, and a user may thus hold the second protrusion 256 in order to detach the second cover 250 from the cyclone chamber 230, or to attach the second cover 250 to the cyclone chamber 230.

The second cover 250 is disposed opposite the first cover 240, and is detachably attached to the cyclone chamber 230. A user may detach the second cover 250 from the cyclone chamber 230, and clean the outlet 220 of the cyclone chamber 230.

A sealing gasket 252 is formed around the outer surface of the second cover 250, in order to seal a gap between the second cover 250 and the cyclone chamber 230.

The second cover 250 includes a filter member housing 253 where a filter member 400 is mounted. The cyclone chamber may not separate fine particle dust, so the cyclone cleaner may use the filter member 400 to separate fine particle dust. In a conventional cleaner, the filter member 400 is in the cleaner body 120, and a user experiences inconvenience in changing or cleaning the filter member 400. According to the second exemplary embodiment of the present disclosure, the filter member 400 is disposed in the filter member housing 253 of the second cover 250 that is detached from the cyclone chamber 230. Accordingly, a user has only to detach the second cover 250 from the cyclone chamber 230 in order to change, clean, or check the filter member 400.

Air holes 254 formed in the filter member housing 253 allow air to pass through as shown in FIGS. 7 and 8. The air passing through the grill 235 flows into the filter member 400. The air from which fine particle dust is separated by the filter member 400 is discharged to the outlet 220 through the air holes 254 formed in the filter member housing 253.

The filter member housing 253 includes a gutter 255 as shown in FIG. 7. The gutter prevents the dust from dropping from the filter member 400 when a user detaches the filter member 400 from the filter member housing 253. Accordingly, the user can change the filter member 400 cleanly.

The operation of the cyclone dust-separating apparatus 200' according to a third exemplary embodiment of the present disclosure will be explained below.

The dust-laden air flows into the cyclone chamber 230 through the inlet 210 as shown in FIGS. 4 and 7. The whirling air current is generated in the cyclone chamber 230 about the horizontal rotating axis A in the cyclone chamber 230 as indicated by arrow 231, and the stabilizer pipe 243 guides the whirling air current. The dust is made to fall down into the dust receptacle 300 through the dust outlet 232 by the centrifugal force. The air from which dust is separated passes the grill 235 as indicated by the arrow 233, and flows to the filter member 400. The grill 235 causes dust that is not separated by the centrifugal force not to be discharged to the outlet 220. Referring to FIG. 8, the air from which fine particle dust is separated by the filter member 400 is discharged to the outlet 220 passing through the air holes 254 formed in the filter member housing 253 as indicated by the arrow 236.

Large particles of dust or tangled hairs clog the passage of the cyclone chamber 230, or become attached to the grill 235, so an excessive load is applied to the motor, and the dust-separating efficiency deteriorates. In the worst case, the cleaner 100 does not operate. In this case, the user may detach the first cover 240 from the cyclone chamber 230, and clean the inside of the cyclone chamber 230 and the grill 235 easily, and may also detach the second cover 250 from the cyclone chamber 230, and clean around the outlet 220 of the cyclone chamber 230, and clean or change the filter member 400.

According to the cyclone dust-separating apparatus of the present disclosure, a user may separate a cover from a cyclone chamber in order to maintain and repair the cyclone chamber.

As the cyclone dust-separating apparatus is disposed horizontally on a cleaner body, the cleaner may be miniaturized.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A cyclone dust-separating apparatus, comprising:

a cyclone chamber that separates dust using a whirling air current about a horizontal rotating axis;

a first cover that is detachably attached to an end of the cyclone chamber to expose the cyclone chamber, the first cover comprising a stabilizer pipe to guide the whirling air current;

a first hinge unit that rotatably fixes the first cover to the cyclone chamber;

a second cover that is detachably attached to an opposite end of the cyclone chamber to expose the cyclone chamber, wherein the second cover comprises a filter member housing to mount a filter member; and a second hinge unit that rotatably fixes the second cover to the cyclone chamber.

2. The apparatus of claim 1, further comprising a grill formed in the cyclone chamber to separate dust larger than a predetermined particle size.

3. The apparatus of claim 1, further comprising a sealing gasket formed around the outer surface of the first cover.

4. The apparatus of claim 1, further comprising a sealing gasket formed around the outer surface of the second cover.

5. The apparatus of claim 1, wherein the filter member housing comprises a gutter to prevent the dust from dropping when the filter member is changed.

6. The apparatus of claim 1, wherein the filter member housing comprises air holes to allow air to pass through the filter member housing.

7. The apparatus of claim 1, wherein the cyclone chamber is made of a transparent material.

8. The apparatus of claim 1, wherein the cyclone chamber is made of a semitransparent material.

9. The apparatus of claim 1, further comprising:

an inlet through which dust-laden air flows into the cyclone chamber; and an outlet through which air from which dust has been separated by the cyclone chamber is discharged.

10. The apparatus of claim 9, wherein the inlet is parallel with the outlet, and wherein the inlet and outlet are disposed on a rear surface of the cyclone chamber.

11. The apparatus of claim 9, wherein the inlet is disposed on the rear surface of the cyclone chamber and the outlet is disposed on a side surface of the cyclone chamber.

12. A cleaner comprising:

a cleaner body;

a brush assembly that draws in dust-laden air from a surface being cleaned; and a cyclone dust-separating apparatus that separates the dust from the air, and is horizontally mounted to the cleaner body, wherein the cyclone dust-separating apparatus comprises:

a cyclone chamber that separates dust-laden air using a whirling air current about a horizontal rotating axis, a first cover that is detachably attached to an end of the cyclone chamber to expose the cyclone chamber, the first cover comprising a stabilizer pipe to guide the whirling air current, a first hinge unit that rotatably fixes the first cover to the cyclone chamber, a second cover that is detachably attached to an opposite end of the cyclone chamber in order to expose the cyclone chamber, wherein the second cover comprises a filter member housing to mount a filter member, and a second hinge unit that rotatably fixes the second cover to the cyclone chamber.

13. The cleaner of claim 12, further comprising a grill formed in the cyclone chamber to separate dust larger than a predetermined particle size.

14. The cleaner of claim 12, wherein the filter member housing comprises a gutter to prevent the dust from dropping when the filter member is changed.

15. The cleaner of claim 12, wherein the cyclone chamber is made of a transparent material.

16. The cleaner of claim 12, wherein the cyclone chamber is made of a semitransparent material.

* * * * *